US007321286B2

(12) United States Patent
Nojima et al.

(10) Patent No.: US 7,321,286 B2
(45) Date of Patent: Jan. 22, 2008

(54) ELECTRICAL JUNCTION BOX

(75) Inventors: Shigeru Nojima, Yokkaichi (JP); Manabu Matsumoto, Okazaki (JP); Mitsuhiro Kato, Nishikamo-gun (JP); Jun Saito, Toyokawa (JP)

(73) Assignee: Sumitomo Wiring Systems, Ltd., Mie (JP)

( * ) Notice: Subject to any disclaimer, the term of this patent is extended or adjusted under 35 U.S.C. 154(b) by 257 days.

(21) Appl. No.: 10/971,159

(22) Filed: Oct. 25, 2004

(65) Prior Publication Data

US 2005/0116807 A1 Jun. 2, 2005

(30) Foreign Application Priority Data

Dec. 2, 2003 (JP) ..... 2003-403613

(51) Int. Cl.
*H01H 85/20* (2006.01)
*H01H 85/02* (2006.01)
*H02B 1/18* (2006.01)

(52) U.S. Cl. ..... 337/189; 337/186; 337/187; 337/188; 361/642

(58) Field of Classification Search ..... 337/290, 337/186–189; 361/642
See application file for complete search history.

(56) References Cited

U.S. PATENT DOCUMENTS 4,842,534 A * 6/1989 Mobley et al. ..... 439/214
5,088,940 A * 2/1992 Saito ..... 439/620.34
5,438,310 A * 8/1995 Ikari ..... 337/208
5,643,693 A * 7/1997 Hill et al. ..... 429/121
5,795,193 A * 8/1998 Yang ..... 439/620.27
5,857,874 A 1/1999 Takeuchi
5,886,611 A * 3/1999 Schaller et al. ..... 337/189
6,524,136 B2 2/2003 Kawaguchi et al.
6,759,938 B2 * 7/2004 Matsumura et al. ..... 337/161
6,806,421 B2 * 10/2004 Matsumura ..... 174/50
6,824,430 B2 * 11/2004 Matsumura et al. ... 439/620.29
6,830,482 B2 * 12/2004 Matsumura et al. ... 439/620.27
7,071,808 B2 * 7/2006 Nakamura ..... 337/256
7,176,780 B2 * 2/2007 Iwata ..... 337/188
2002/0167390 A1 * 11/2002 Matsumura et al. ..... 337/161

FOREIGN PATENT DOCUMENTS

JP A-08-111165 4/1996
JP A-10-283907 10/1998
JP A-11-187545 7/1999

* cited by examiner

*Primary Examiner*—Anatoly Vortman
(74) *Attorney, Agent, or Firm*—Oliff & Berridge, PLC

(57) ABSTRACT

In order to readily remove a fusible link fastened by a bolt from an electrical junction box, an electrical junction box includes a bus bar made of an electrical conductive metallic plate and that has an input terminal section, a plurality of output terminal sections, narrow fusible portions interposed between the input and output terminal sections. The junction box further includes a fusible link embedding the bus bar in molded resin integrally, a body casing containing the fusible link, and a press fitting terminal coupled to an end of an electrical power source cable. The press fitting terminal is connected to the input terminal section by a bolt. A bolt-joining portion between the input terminal section and the press terminal is disposed on a position higher than an upper surface of the body casing or a position opposite to an cutout provided in the body casing. A bolt-handling space for fastening or releasing a bolt is defined at a position opposite to the bolt-joining portion.

2 Claims, 6 Drawing Sheets

ELECTRICAL JUNCTION BOX

CROSS-REFERENCE TO RELATED APPLICATION

The invention claims priority to Japanese Patent Application No. JP 2003-403613 filed on Dec. 2, 2003. The disclosure of the prior application is incorporated herein by reference in its entirety.

BACKGROUND OF THE INVENTION

1. Field of Invention

This invention relates to an electrical junction box and more particularly relates to an electrical junction box in which an integrated FL (fusible link) includes a fusible link having a narrow fusible portion and an input terminal section provided on a bus bar, and the input terminal section is fastened on a terminal coupled to an end of an electrical power source cable by a bolt, thereby facilitating exchange of the fusible link and improving a service function.

2. Description of Related Art

Heretofore, in an electrical junction box installed in a motor vehicle, a terminal of a fusible link is fastened to a terminal coupled to an end of an electrical cable by a bolt in many cases. For example, as shown in FIGS. 6A and 6B, Japanese Patent Public Disclosure HEI 10-283907 (1998) discloses an electrical junction box 1 in which when a fusible link 4 is accommodated in a fusible link containing-section 3 provided in a upper wall of a body casing 2, a terminal section 5 of the fusible link 4 is disposed within the body casing 2 and the terminal section 5 is fastened to a terminal 6 coupled to an end of an electrical cable by a bolt.

After fastening the terminal section 5 of the fusible link 4 on the cable end terminal 6 by the bolt, a lower cover 7 is mounted on a lower surface of the body casing 2 while an upper cover 8 is mounted on an upper surface of the body casing 2. Then, the upper and lower covers 8 and 7 are interlocked.

However, according to the above structure of the electrical junction box, because the terminal section 5 of the fusible link 4 is fastened to the cable end terminal 6 by the bolt in the body casing 2, when exchanging the fusible link 4, firstly the electrical junction box 1 is removed from a vehicle body, secondly the lower cover 7 is removed from the body casing 2, thirdly the bolt is released from the fusible link terminal section 5 and cable end terminal 6, fourthly the upper cover 8 is removed from the body casing 2, and finally the fusible link 4 is drawn out from the body casing 2. Thus, such a work of removing the fusible link becomes very complicated.

In view of the above problems, an object of various exemplary embodiments of the invention is to provide an electrical junction box from which a fusible link fastened by a bolt can be readily removed.

SUMMARY OF THE INVENTION

In order to achieve the above object, a first aspect of various exemplary embodiments of the invention is directed to an electrical junction box comprises: a bus bar made of an electrical conductive metallic plate and including an input terminal section, a plurality of output terminal sections, and a fusible link section having narrow fusible portions interposed between the input and output terminal sections; a housing section containing a part of the bus bar integrally; and a body casing accommodating the housing section detachably.

A bolt-joining portion between the input terminal section of the bus bar and a terminal coupled to an end of an electrical power source cable is projected over an upper surface of the body casing or is disposed at a position opposite to an cutout provided in a peripheral wall of the body casing. Thus, a work for fastening or leasing a bolt can be carried out without removing the housing section containing the bus bar from the body casing.

According to the above construction, because the bolt-joining portion between the input terminal section of the fusible link having the bus bar and the terminal coupled to the end of the electrical power source cable is disposed not within the body casing but above the upper surface of the body casing, the bolt-joining portion is exposed merely by removing the upper cover from the body casing and the bolt is released when removing the fusible link, thereby facilitating a work of removing the fusible link.

Also, because the bolt-joining portion is disposed at the position higher than the upper surface of the body casing or at the position opposite to the cutout provided in the body casing and the handling space for fastening or releasing the bolt is defined at a position opposite to the bolt-joining portion, the bolt can be readily removed and drawn out the fusible link from the body casing.

Also, because the bolt can fasten the input terminal section of the fusible link on the terminal coupled to the end of the electrical power source cable while the fusible link is contained in the body casing, fastening or releasing the bolt can be facilitated.

Also, a second aspect of various exemplary embodiments of the invention is directed to an electrical junction box comprises: a bus bar made of an electrical conductive metallic plate and including an input terminal section, a plurality of output terminal sections, and a fusible link section having narrow fusible sections interposed between the input and output terminal sections; a housing section containing a part of the bus bar integrally; a body casing accommodating the housing section detachably; and an intermediate bus bar disposed in the body casing perpendicularly.

The input terminal section of the bus bar is disposed horizontally along an upper surface of the body casing. The input terminal section is superposed on a bolt-joining portion angled horizontally from an upper end of the intermediate bus bar and fastened by a bolt. A lower end of the intermediate bus bar being fastened to a terminal coupled to an end of an electrical power source cable by a bolt. Thus, a handling work for fastening or releasing a bolt can be carried out without removing the housing section containing the bus bar from the body casing.

According to the above construction, because the bolt-joining portion of the input terminal section of the fusible link extends horizontally along the upper surface of the body casing of the electrical junction box, that is, the bolt-joining portion projects to be directed upward, fastening or releasing the bolt is facilitated.

Also, because it is not necessary to arrange the electrical power source cable from a lower part of the body casing to an upper part of the body casing and the thin intermediate bus bar interconnects the input terminal section of the fusible link and the terminal coupled to the end of the electrical power source cable, it is possible to reduce a space and to make a compact electrical junction box.

At least two housing sections containing the bus bars integrally may be contained detachably in the body casing. Input terminal sections projecting from the housing sections may be superposed on a bolt-joining portion of the intermediate bus bar and fastened together by a bolt.

According to the above structure, the input terminal sections of the plural fusible links can be released from or fastened to the terminal coupled to the end of the electrical power source cable by a single work for releasing or fastening the bolt.

Because various exemplary embodiments of the invention enable fastening or releasing the bolt while the body casing contains the fusible links, fastening or releasing a batch bolt can be performed.

A part of the bus bar is molded in the housing section integrally. Otherwise, the bus bar may be integrally secured in the housing section by press-fitting or screw means.

It will be apparent from the foregoing that according to various exemplary embodiments of the invention because the bolt-joining portion between the input terminal section of the fusible link having the bus bar and the terminal coupled to the end of the electrical power source cable is disposed not within the body casing but above the upper surface of the body casing, the bolt-joining portion is exposed merely by removing the upper cover from the body casing and the bolt is released when removing the fusible link, thereby facilitating a work of removing the fusible link.

Also, in the first aspect of various exemplary embodiments of the invention, because the bolt-joining portion is disposed at the position higher than the upper surface of the body casing or at the position opposite to the cutout provided in the body casing and the handling space for fastening or releasing the bolt is defined at a position opposite to the bolt-joining portion, the bolt can be readily removed and drawn out the fusible link from the body casing.

In the second aspect of various exemplary embodiments of the invention, because the bolt-joining portion of the input terminal section of the fusible link extends horizontally along the upper surface of the body casing of the electrical junction box, that is, the bolt-joining portion projects to be directed upward, fastening or releasing the bolt can be performed.

BRIEF DESCRIPTION OF THE DRAWINGS

The accompanying drawings, which are incorporated into and constitute a part of the specification, illustrate one or more embodiments of the invention and, taken with the detailed description, serve to explain the principles and implementations of the invention. In the drawings.

DETAILED DESCRIPTION OF EXEMPLARY EMBODIMENTS

Figure 1A:
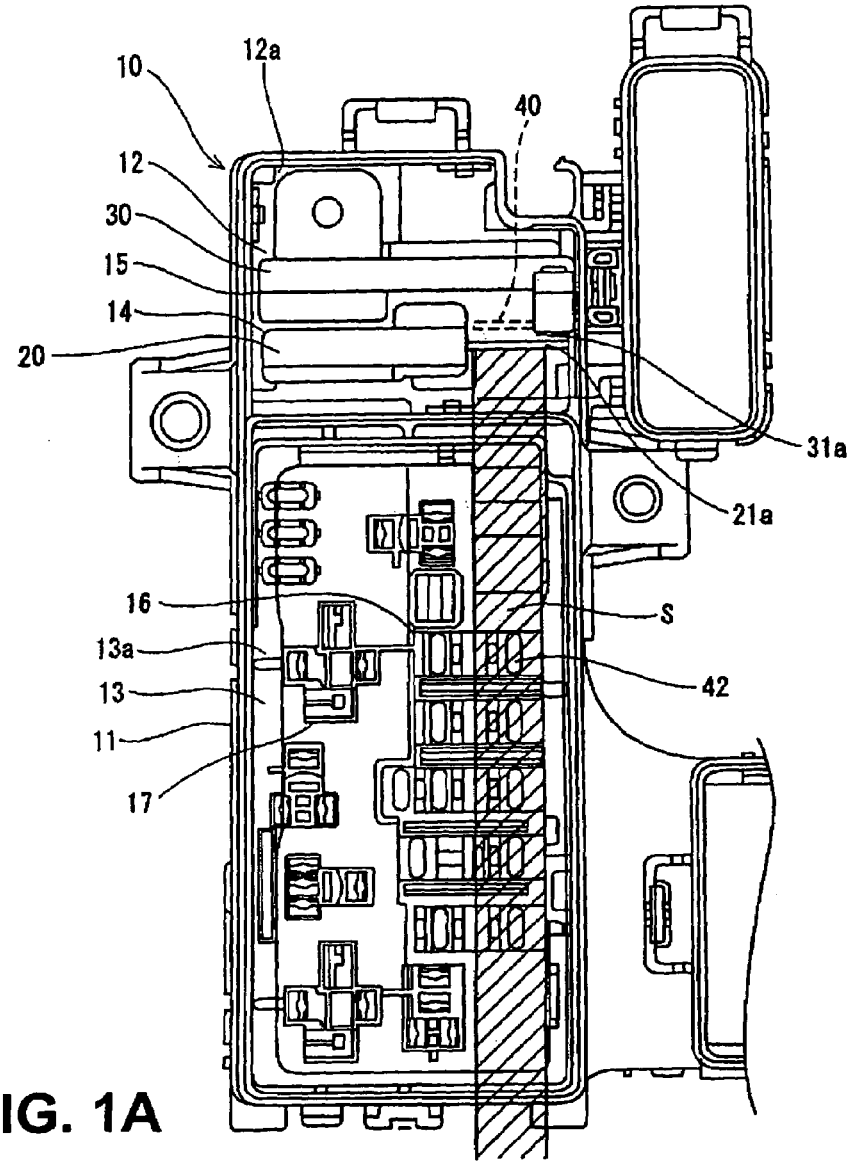
FIG. 1A is a plan view of a first embodiment of an electrical junction box in accordance with various exemplary embodiments of the invention.

Embodiments of an electrical junction box in accordance with various exemplary embodiments of the invention will be described below by referring to the drawings.

Figure 1B:
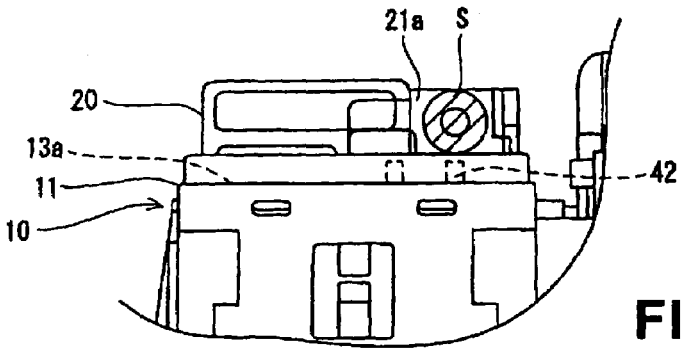
FIG. 1B is a front elevation view of FIG. 1A.
Figure 2:
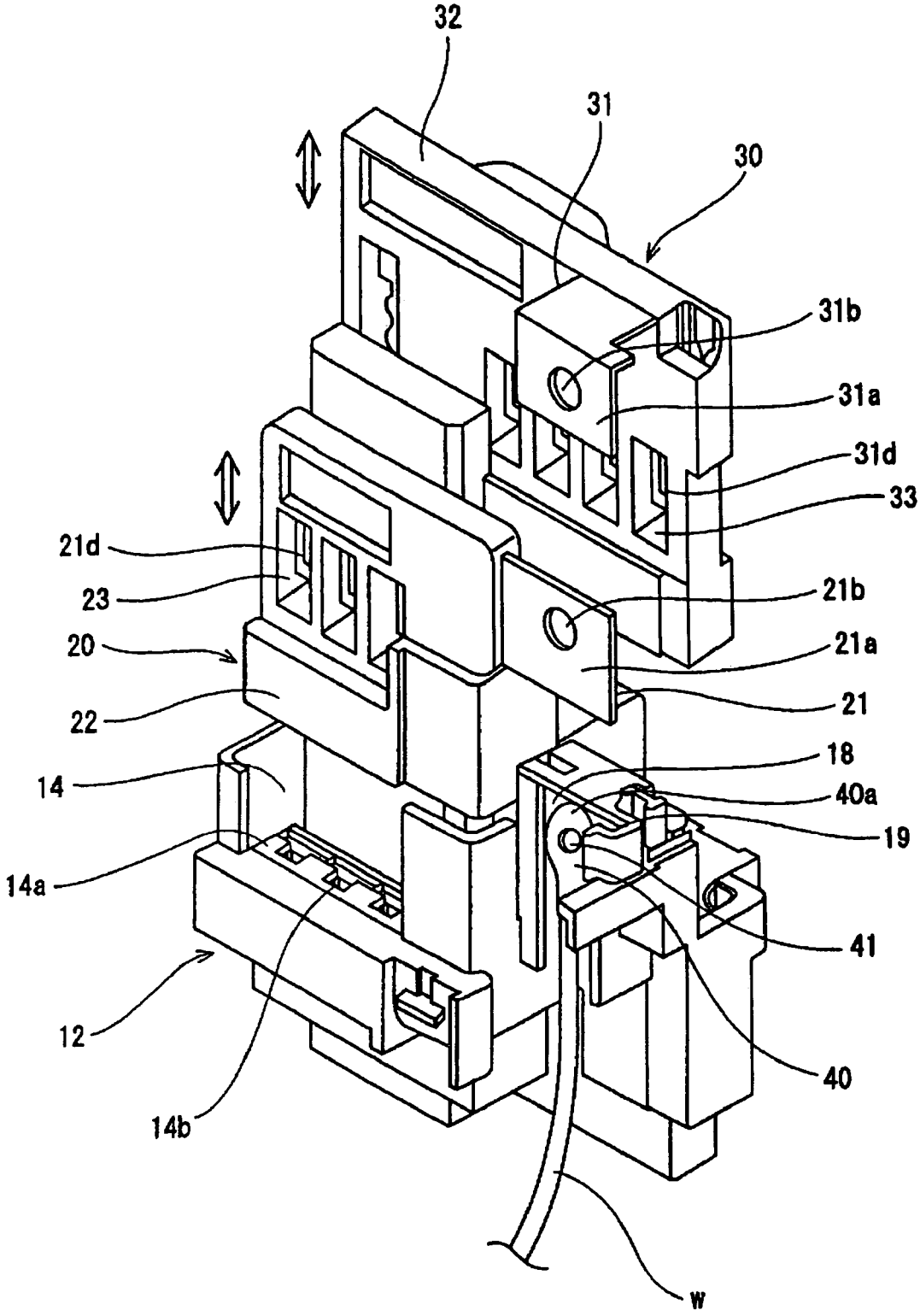
FIG. 2 is a perspective view of a first casing member and first and second fusible links.
Figure 3:
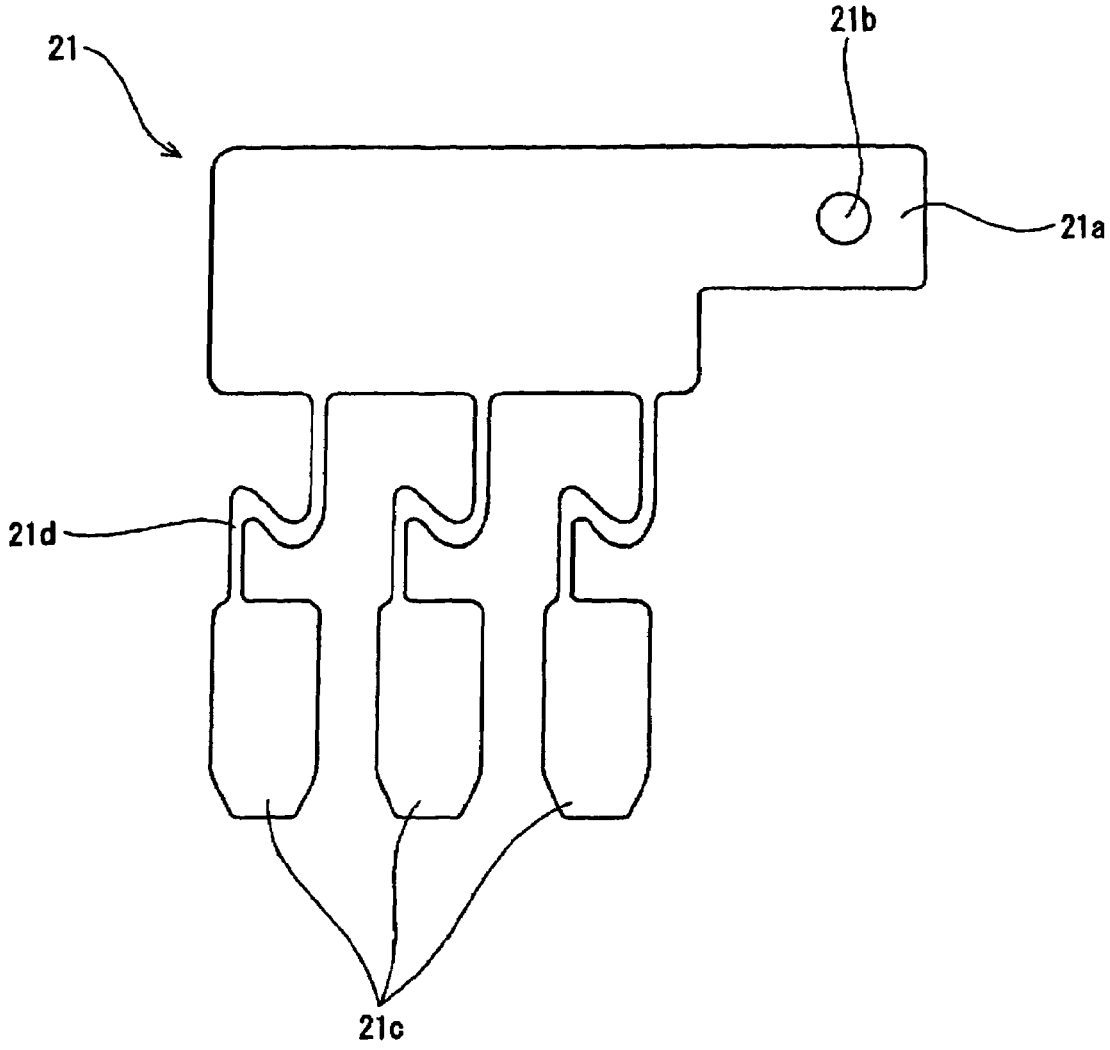
FIG. 3 is a plan view of a bus bar to be molded in the first fusible link.

FIGS. 1 to 3 show a first embodiment of an electrical junction box in accordance with various exemplary embodiments of the invention.

An electrical junction box 10 includes a body casing 11 comprising a first casing member 12 and a second casing member 13 (an upper cover is omitted in the drawings). The first and second casing members 12 and 13 are installed horizontally in the body casing 11. As shown in FIG. 1A, the first casing member 12 is provided on an upper surface 12*a* with a first fusible link containing-section 14 for accommodating a first integrated fusible link 20 (hereinafter referred to a "first fusible link" 20) and with a second fusible link containing-section 15 for accommodating a second integrated fusible link 30 (hereinafter referred to a "second fusible link" 30). On the other hand, the second casing member 13 is provided on an upper surface 13*a* with a plurality of fuse containing-sections 16 and a plurality of relay containing-sections 17.

The first fusible link containing-section 14 of the first casing member 12 is provided on a sidewall with a press fitting terminal containing-section 18 that receives an electrical connecting-section 40*a* of a press fitting terminal 40 from a lower side. The electrical connecting-section 40*a* is provided with a bolt hole 41. The press fitting terminal 40 is connected to an end of an electrical power source cable w. A nut (not shown) is embedded previously in the press fitting terminal containing-section 18. A terminal receiving groove 19 is provide near the press fitting terminal containing-section 18 so that the groove 19 receives an input terminal section 21*a* of the first fusible link 20 and an input terminal section 31*a* of the second fusible link 30.

The terminal receiving groove 19 is cut out at a position opposed to a bolt hole 21*b* in the input terminal section 21 so that the input terminal sections 21*a* and 31*a* inserted in the terminal receiving groove 19 and the press fitting terminal 40 accommodated in the press fitting terminal containing-section 18 can be fastened laterally by a bolt.

The first and second fusible links 20 and 30 to be contained in the first casing member 12 are integrated together with bus bars 21 and 31 by resin molding, respectively. As shown in FIG. 3, the bus bar 21 to be molded in the first fusible link 20 is provided on an end with the input terminal section 21*a* having a bolt hole 21*b* and on the other end with a plurality of output terminal sections 21*c*.

Narrow fusible portions 21*d* having narrow widths are provided between the input terminal section 21*a* and the output terminal sections 21*c*. The bus bar 31 to be molded in the second fusible link 30 is provided with an input terminal section 31*a*, output terminal sections (not shown), and narrow fusible portions (not shown) in the same manner as the bus bar 21.

As shown in FIG. 2, in the first and second fusible links 20 and 30, the input terminal sections 21*a* and 31*a* having the bolt holes 21*b* and 31*b* extend from housing sections 22 and 32 in which the bus bars 21 and 31 are embedded by resin molding. The input terminal section 21*a* of the first fusible link 20 extends laterally from an upper part of a sidewall of the housing section 22 so that the input terminal section 21*a* is inserted into the terminal receiving groove 19 when the first fusible link 20 is accommodated in the first fusible link containing-section 14.

On the other hand, a base portion of the input terminal section 31*a* of the second fusible link 30 extends toward the first fusible link 20 and an angled portion depending from the base portion contacts with the input terminal section 21*a* of the first fusible link 20, when the first and second fusible links 20 and 30 are accommodated in the first and second fusible link containing-sections 14 and 15, respectively.

The narrow fusible portions 21*d* and 31*d* provided on the bus bars 21 and 31 of the first and second fusible links 20 and 30 are exposed from windows 23 and 33 provided in the housing sections 22 and 32, so that the narrow fusible portions 21*d* and 31*d* are positively blown out when overcurrent flows in the narrow fusible portions 21*d* and 31*d* and one can view whether they are blown out or not.

Furthermore; the output terminal sections 21*c* and 31*c* (the output terminal section 31*c* of the bus bar 31 is not shown in the drawing) are exposed at the lower surface sides of the housing sections 22 and 32, that is, at the sides opposed to the bottom surfaces 14*a* and 15*a* of the first and second fusible link containing-sections 14 and 15 (the bottom surface 15*a* of the second fusible link containing-section 15 is not shown in the drawing).

Although the bus bars are embedded in the housing sections by resin molding in this embodiment, the bus bars may be contained in housings including resin casings.

When the first and second fusible links 20 and 30 are accommodated in the first and second fusible link containing-sections 14 and 15 of the first casing member 12, the input terminal sections 21*a* and 31*a* of the first and second fusible links 20 and 30 are inserted into the terminal receiving-groove 19 in the first casing member 12. At this time, the bolt holes 21*b* and 31*b* in the input terminal sections 21*a* and 31*a* are aligned axially with the bolt hole 41 in the press fitting terminal 40 accommodated in the press fitting terminal containing-section 18. A bolt is inserted into the bolt holes 21*b*, 31*b*, and 41 and a nut is engaged with the bolt.

The output terminal sections of the first and second fusible links 20 and 30 are disposed to oppose the terminal holes 14*b* and 15*b* (the terminal hole 15*b* in the second fusible link containing-section 15 is not shown in the drawing) provided in the bottom walls 14*a* and 15*a* (the bottom wall 15*a* of the second fusible link containing-section 15 is not shown in the drawing) in the first and second fusible link containing-sections 14 and 15. The output terminal sections are connected to terminals (not shown) coupled to ends of output side electrical cables inserted upward through the terminal holes 14*b* and 15*b*.

The input terminal sections 21*a* and 31*a* inserted in the terminal receiving-groove 19 in the first casing member 12 and the press fitting terminal 40 accommodated in the press fitting terminal containing-section 18 are disposed to oppose the fuse containing-section 16 of the second casing member 13, as shown in FIG. 1A, and disposed at a position higher than a fuse 42 accommodated in the fuse containing-section 16, as shown in FIG. 1B.

Consequently, a bolt-handling space S for fastening or releasing a bolt, as shown by diagonal lines in FIGS. 1A and 1B, is defined. In the case of exchanging the first and second fusible links 20 and 30, it is possible to readily remove the bolt that fastens the press fitting terminal 40 to the input terminal sections 21*a* and 31*a* of the first and second fusible links 20 and 30.

According to the above structure, because a bolt-joining portion between the input terminal sections 21*a* and 31*a* of the first and second fusible links 20 and 30 and the press fitting terminal 40 coupled to the end of the electrical power source cable is disposed not within the body casing 11 but above the upper surface of the body casing 11, the bolt-joining portion is exposed outward merely by removing the upper cover from the body casing 11 and to readily remove the first and second fusible links 20 and 30.

Also, because the input terminal sections 21*a* and 31*a* inserted in the terminal receiving-groove 19 in the first casing member 12 and the press fitting terminal 40 accommodated in the press fitting terminal containing-section 18 are disposed at a position higher than the fuse 42 accommodated in the fuse containing-section 16, the fuse 42 does not interfere the work of removing the bolt and thus the bolt is easily removed.

Although the bus bars are embedded in the housing sections by resin molding to form the fusible links in various exemplary embodiments of the invention, the bus bars may be accommodated in a resin housings and the housings may be closed by screws or locking means.

Figure 4:
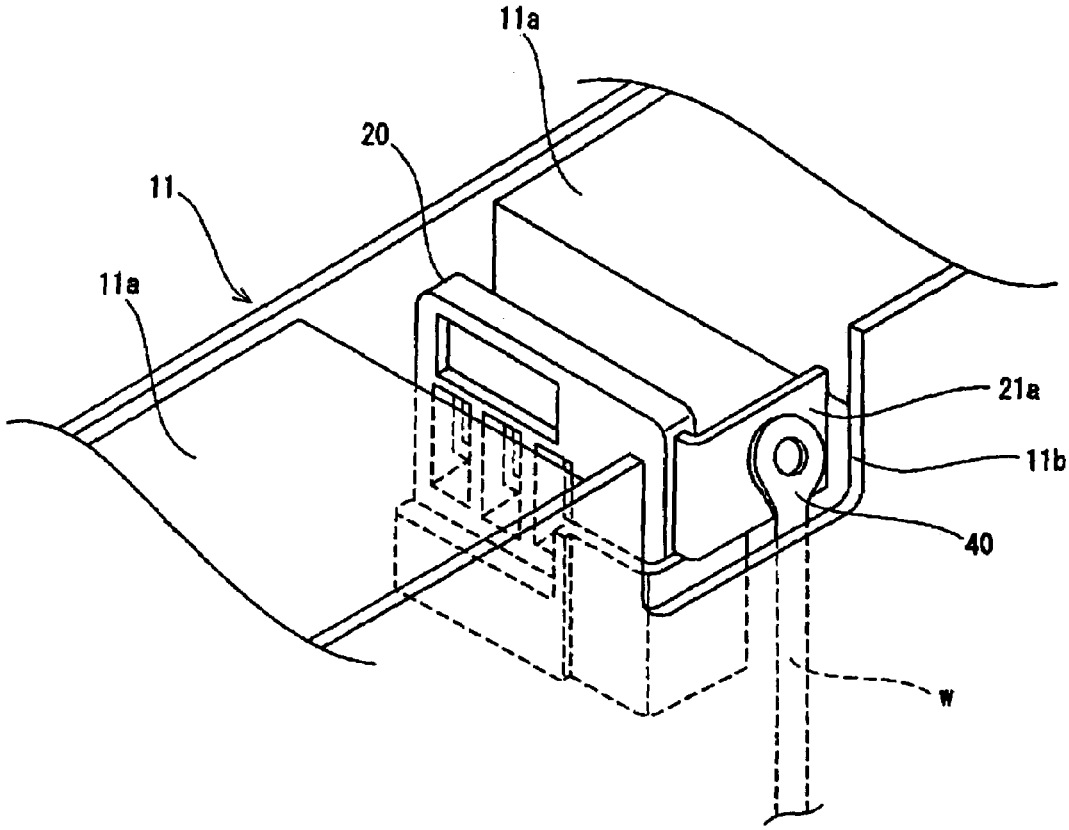
FIG. 4 is a perspective view of a second embodiment of an electrical junction box in accordance with various exemplary embodiments of the invention.

FIG. 4 shows a second embodiment of the electrical junction box in accordance with various exemplary embodiments of the invention. In the second embodiment, a bolt-joining portion between the input terminal section 21*a* of the first fusible link 20 and the press fitting terminal 40 coupled to the end of the electrical power source cable w is disposed at a position lower than the upper surface 11*a* of the body casing 11. The body casing 11 is provided in a peripheral wall with a cutout 11*b*. The bolt-handling space S for fastening or releasing a bolt is provided at a position opposite to the bolt-joining portion. The cutout 11*b* is closed by the upper cover (not shown).

According to the above structure, because the bolt-handling space S for fastening or releasing a bolt is provided at the position opposite to the bolt-joining portion between the input terminal section 21*a* of the first fusible link 20 and the press fitting terminal 40 coupled to the end of the electrical power source cable w, the first fusible link 20 can be removed by removing the bolt utilizing the space S upon exchanging the first fusible link 20.

Because the other constructions and operational effects in the second embodiment are the same as those in the first embodiment, the explanation of them is omitted here by giving the same signs to the same elements.

Figure 5:
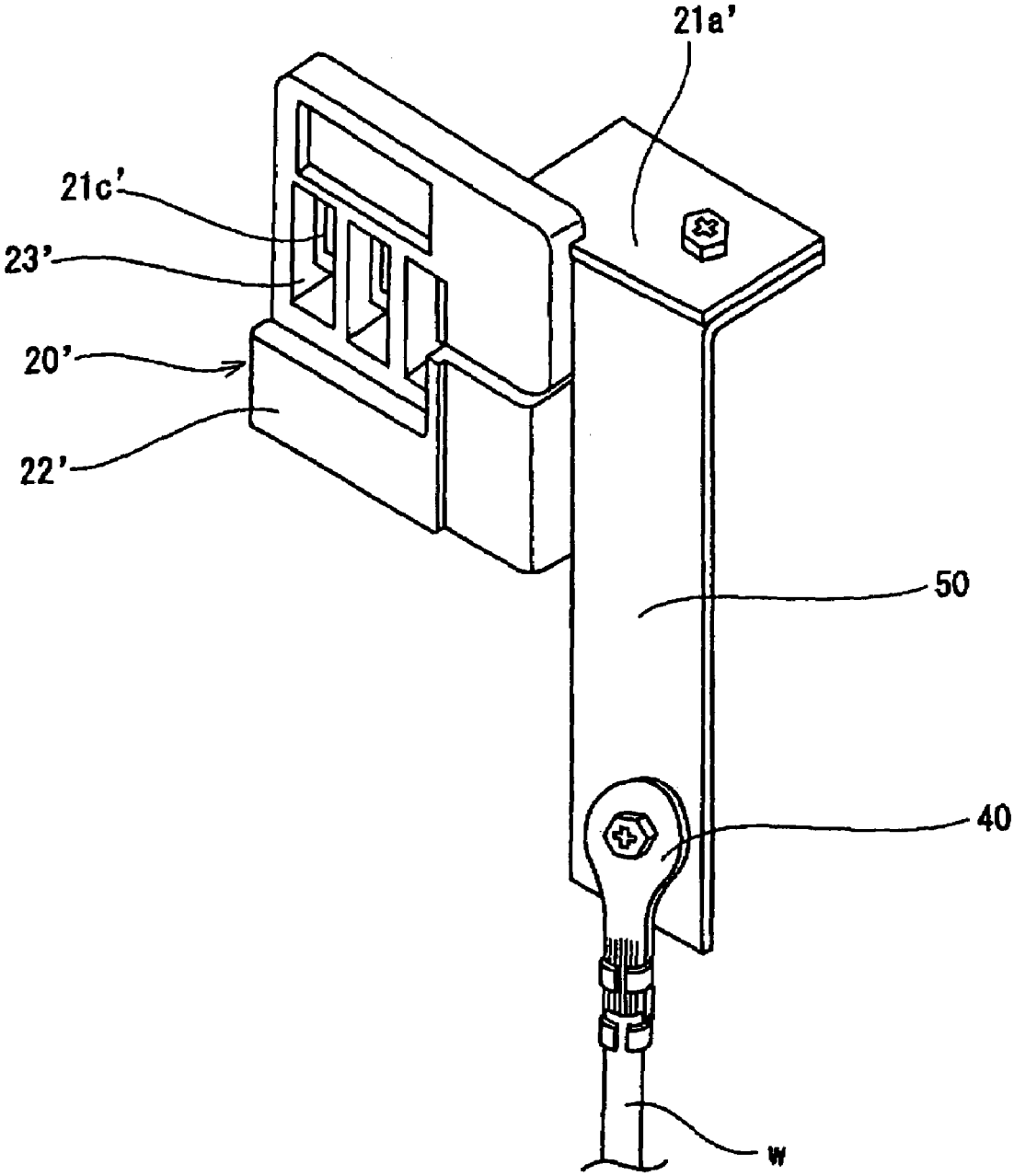
FIG. 5 is a perspective view of a third embodiment of an electrical junction box in accordance with various exemplary embodiments of the invention, illustrating a connecting structure between a fusible link and an electrical power source cable.
Figure 6A:
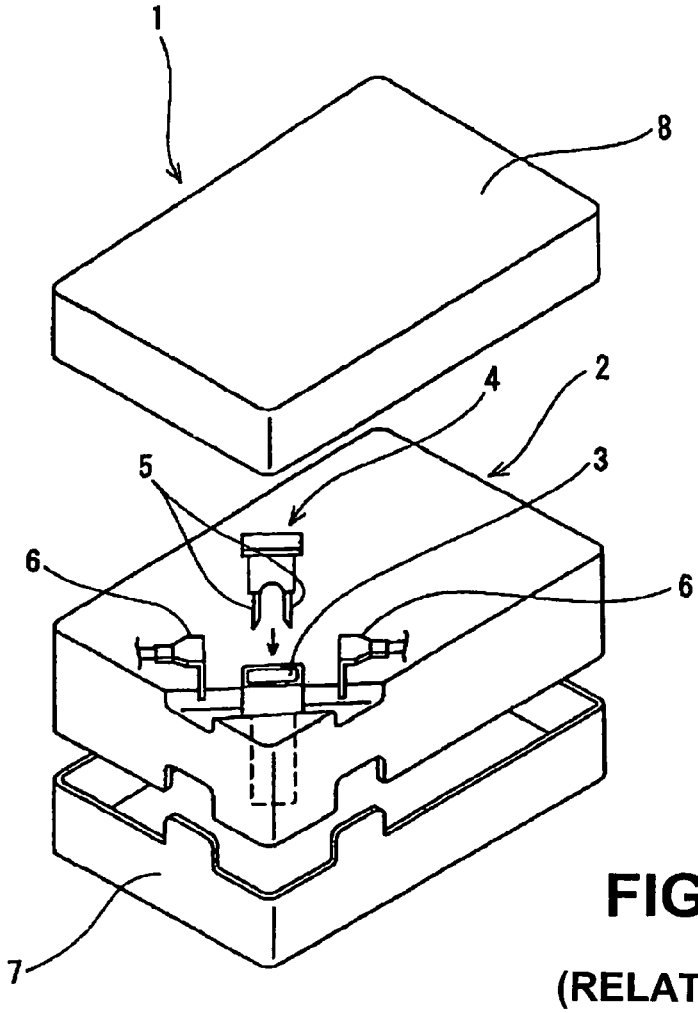
FIG. 6A (RELATED ART)
FIG. 6A is an exploded perspective view of a conventional electrical junction box.
Figure 6B:
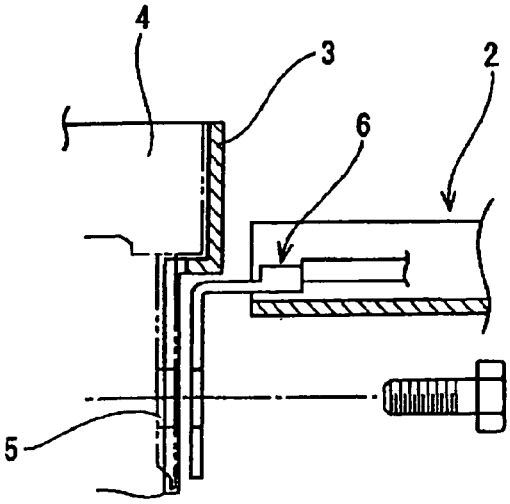
FIG. 6B (RELATED ART)
FIG. 6B is a partial cross sectional view of the junction box shown in FIG. 6A.

FIG. 5 shows a third embodiment of the electrical junction box in accordance with various exemplary embodiments of the invention. The third embodiment differs from the first embodiment with respect to a method for interconnecting the electrical power source cable w and the input terminal section 21*a* of the first fusible link 20 to each other.

Although the input terminal section 21*a* of the first fusible link 20 and the press fitting terminal 40 coupled to the end of the electrical power source cable w are brought into contact with each other directly and fastened by the bolt in the first embodiment, an intermediate bus bar 50 extending vertically in the body casing 11 of the electrical junction box is interposed between the terminals.

In a first fusible link 20' in the third embodiment, an input terminal section 21*a*' extends horizontally from a housing section 22' at an upper surface side with a bolt fastening surface of the input terminal section 21*a*' being directed upward. An intermediate bus bar 50 disposed in the electrical junction box is provided in upper and lower ends with bolt holes (not shown).

An upper end of the intermediate bus bar 50 is bent horizontally, is superposed on the input terminal section 21*a*' of the first fusible link 20, and is fastened by a bolt. On the other hand, a bolt hole in a lower end of the intermediate bus bar 50 is aligned axially with the bolt hole in the press fitting terminal 40 and the bolt holes are fastened by a bolt.

According to the above structure, because the input terminal section 21*a*' of the first fusible link 20' projects horizontally along the upper surface of the body casing, it is possible to remove only the upper cover from the electrical junction box and exchange the first fusible link 20' from the upper side. A plurality of fusible links may be contained in the body casing in the same manner as the first embodiment.

In this case, the intermediate bus bar may be branched and the branched portions may be connected to input terminal sections of the fusible links disposed on any positions, respectively. Otherwise, plural input terminal sections are superposed together with one another and the superposed input terminal sections are fastened to the bus bar by a bolt.

Because the other constructions and operational effects in the third embodiment are the same as those in the first embodiment, the explanation of them is omitted here by giving the same signs to the same elements.

While the invention has been particularly described, in conjunction with specific preferred embodiments, it is evident that many alternatives, modifications, and variations will be apparent to those skilled in the art of the foregoing description. It is therefore contemplated that the appended claims will embrace any such alternatives, modifications, and variations as falling within the true scope and spirit of the invention.

What is claimed is:

1. An electrical junction box, comprising:

a bus bar made of an electrical conductive metallic plate and including an input terminal section, a plurality of output terminal sections, and a fusible link section having narrow fusible portions interposed between the input and output terminal sections;

a housing section containing a part of the bus bar integrally;

a body casing accommodating the housing section detachably; and a bolt-joining portion between the input terminal section of the bus bar and a terminal coupled to an end of an electrical power source cable being projected over an upper surface of the body casing, wherein fastening or releasing a bolt associated with the bolt-joining portion can be performed without removing the housing section containing the bus bar from the body casing.

2. The electrical junction box according to claim 1, wherein at least two housing sections containing bus bars integrally are contained detachably in the body casing, input terminal sections projecting from the housing sections are disposed along the bolt-joining portion of the end of the electrical power source cable and fastened together by the bolt.

* * * * *